United States Patent [19]

Schwartz et al.

[11] 4,012,546

[45] Mar. 15, 1977

[54] FLAME-RETARDANT CARPET

[75] Inventors: Judd Leonard Schwartz, Chester; Richard Eugene Mayer, Richmond, both of Va.

[73] Assignee: Allied Chemical Corporation, N.J.

[22] Filed: Aug. 6, 1976

[21] Appl. No.: 712,287

[52] U.S. Cl. ..... 428/95; 156/72; 428/97; 428/921

[51] Int. Cl.[2] ..... D03D 27/00; D04H 11/00

[58] Field of Search ..... 428/95, 97, 921; 106/15; 252/8.1; 156/72

[56] References Cited

UNITED STATES PATENTS

| | | | |
|---|---|---|---|
| 3,814,661 | 6/1974 | Hart | 428/921 |
| 3,839,140 | 10/1974 | Tyler | 428/921 |

*Primary Examiner*—Marion E. McCamish
*Attorney, Agent, or Firm*—Fred L. Kelly

[57] ABSTRACT

A flame-retardant pile carpet having a relatively pliable primary backing and a tufted surface, said surface being comprised of fibers selected from the group consisting of polyester and polyamide fibers having incorporated therein from 0.05 to 15 percent by weight of a compound selected from the group consisting of antimony oxide and zinc borate, said fibers being bonded to said backing with a bonding substance comprising a latex material and a hydrate material, said latex material being selected from the group consisting of polymers and copolymers of vinyl chloride and vinylidene chloride, and said hydrate material being selected from the group consisting of aluminum hydroxide and hydrated aluminum oxide, the ratio by weight of said latex material to said hydrate material being within the range 1:2 to 1:4.5.

14 Claims, No Drawings

FLAME-RETARDANT CARPET

CROSS-REFERENCES TO RELATED APPLICATIONS

This application is related to our copending application Ser. No. 608,127, filed Aug. 27, 1975.

BACKGROUND OF THE INVENTION

The present invention relates to a flame-retardant carpet and a process for the preparation thereof.

When carpeting is conventionally manufactured, the fibers or pile are tufted on a relatively pliable primary backing which may be manufactured from any suitable materials such as jute or a man-made fiber such as polypropylene. The nonwear side of the backing is then coated with a bonding material of any suitable type such as latex. The latex serves to satisfactorily hold the fibers in place so that they cannot be pulled free from the primary backing and also to bond the primary backing to the secondary backing. In the past, clay has been added to the latex as a filler to reduce the cost of the bonding compound. The secondary backing, which may also be jute or artifical fiber, strengthens the carpet and ensures that the bonding material does not come into contact with the floor upon which the carpet is laid.

U.S. Pat. No. 3,418,267, granted Dec. 24, 1968, relates to flame-resistant polyamides and process thereof. The patent discloses that polyamide resin is made flame-retardant by incorporating therein from 5 to 20 percent by weight of an organic halide, e.g., chlorinated biphenyl, which is reactive with the resin only at its pyrolysis temperature and from 3 to 15 percent by weight of an oxide of tin, lead, copper, iron, zinc, or antimony.

U.S. Pat. No. 3,663,345, granted May 16, 1972, discloses a fire-retardant carpet in which the pile fibers are fixed to the primary backing by a compound comprising a latex binding material combined with an aluminum hydrate.

U.S. Pat. No. 3,719,547, granted Mar. 6, 1973, describes a flame-retardant pile fabric. A fibrous layer composed of combustible filaments or fibers extends from the top surface of a fibrous backing to present a pile surface. A coating of a film-forming halogen-containing polymer and a water-insoluble organo-phosphorus compound is applied to and confined essentially to the top surface of the backing. Where the backing is made of a thermoplastic material, a coating of the halogen-containing polymer may be used without the organo-phosphorus compound.

Although these patents are a major contribution to this art, investigations have been undertaken to produce carpeting that is significantly more flame-retardant than the carpets disclosed in the prior art.

SUMMARY OF THE INVENTION

It is an object of this invention to provide a process for rendering pile carpets flame-retardant without impairing their aesthetic properties. Another object of this invention is to provide pile carpets having flame-retardant properties which are prepared from polyester and polyamide fibers. It is a further object of this invention to provide a process which eliminates the necessity for applying the flame-retardant composition as a separate step in the process of preparing pile carpets.

In summary, the process of the present invention is an improvement over known processes for producing a pile carpet having a relatively pliable primary backing through which polyamide or polyester fibers are tufted. The improvement comprises incorporating in said fibers from 0.05 to 15 percent by weight of a compound selected from the group consisting of antimony oxide and zinc borate, and bonding said fibers to said backing with a bonding substance comprising a latex material selected from the group consisting of vinyl chloride and vinylidene chloride polymers and copolymers, and a hydrate material selected from the group consisting of aluminum hydroxide, hydrated aluminum oxide and hydrated aluminum silicates such as kaolite, dickite, nacrite and endellite, the ratio by weight of said latex material to said hydrate material being from 1:2 to 1:4.5.

The present invention provides a flame-retardant carpet which retains its aesthetic properties and is significantly more flame-retardant than prior art carpets. We postulate that this improvement involves a synergistic interaction between the several elements of the present invention. In one preferred embodiment, the present invention provides a flame-retardant pile carpet having a relatively pliable primary backing and a tufted surface, said surface being comprised of fibers selected from the group consisting of polyester and polyamide fibers having incorporated therein from 0.05 to 15 percent by weight of a compound selected from the group consisting of antimony oxide and zinc borate, said fibers being bonded to said backing with a bonding substance comprising a latex material selected from the group consisting of vinyl chloride and vinylidene chloride polymers and copolymers, and a hydrate material selected from the group consisting of aluminum hydroxide and hydrated aluminum oxide, the ratio by weight of said latex material to said hydrate material being within the range 1:2 to 1:4.5.

The term "flame-retardant carpet" is used herein to mean that the carpet burns very slowly in a confined area when exposed in air to a direct flame or its equivalent. The preferred method of testing for flame-retardant properties may be referred to as the "Critical Radiant Flux Test" described in a report entitled NBSIR 75-950 Proposed Criteria for Use of the Critical Radiant Flux Test Method, which report is available from the National Bureau of Standards, U.S. Department of Commerce.

The test apparatus comprises a gas fired refractory radiant panel inclined at a 30° angle over the exposed portion of a horizontally mounted test specimen. The specimen surface is 3–9 inches below the lower edge of the radiant panel. The radiant panel and an adjustable height specimen transport system are enclosed in an asbestos mill board sheathed chamber with provision for a free flow of draft-free air to simulate natural burning conditions. There is a glass viewing window in the front face of the chamber. Below the window is a door which can be opened to facilitate placement and removal of the test specimen. In the examples herein, the test conditions selected involve a 30° panel angle, a panel temperature of 525° C., and the distance from panel to sample is 5.5 inches. In order to carry out our tests under extremely rigorous conditions, the carpet is burned over a 50 oz./yd.$^2$ hair jute pad. Distance burned (cm.) is recorded and critical energy is determined in terms of flux watts/cm.$^2$.

DESCRIPTION OF THE PREFERRED EMBODIMENT

The preferred polyamides which are useful in the improved flame-retardant carpets of the present invention include polycaprolactam (6 nylon), the polyamides which are derived from the condensation of a dicarboxylic acid with a diamine, such as polyhexamethylene adipamide (66 nylon) and polyhexamethylene sebacamide (610 nylon), and copolymers thereof. The preferred polyesters are the linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-dibenzofuran-dicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate) (75/25).

The primary carpet backing is made from any suitable material. It may be a conventional woven jute construction. Also, the backing may be made of a nonwoven fibrous mass made of cellulosic or noncellulosic material including nylon, polyester, and polyolefin. Other fabric backing structures likewise can be used.

A preferred ethylene-vinyl chloride copolymer latex for use in the present invention is a known composition which is commercially available. For example, it may be purchased under the trademark POLVIN 2500 from Monsanto Company. A typical process for preparing stable ethylene/vinyl chloride copolymer latices is disclosed in U.S. Pat. No. 3,399,157, granted Aug. 27, 1968.

A preferred vinylidene chloride-vinyl chloride copolymer latex may be purchased under the trademark GEON 652 from B. F. Goodrich Chemical Company. Patents relating to preparation of vinylidene chloride copolymer latices include U.S. Pat. Nos. 3,297,613; 3,297,666; 3,317,450; and 3,962,170.

A preferred vinylidene chloride polymer latex is available from Dow Chemical Company as DOW Experimental Latex XD-8600.03. Preferred vinyl chloride latices are available from B. F. Goodrich Chemical Company under the trademark GEON 575X43 and GEON 577. Several patents have recently issued relating to flame and smoke retardant vinyl chloride and vinylidene chloride polymer compositions including U.S. Pat. Nos. 3,880,802; 3,883,480; 3,883,482; 3,914,201; and 3,922,248.

In the preferred latex-hydrate bonding composition of the present invention, it has been found that an aluminum hydrate will produce the desired result in a very satisfactory manner if proper material ratios are used. It has been determined that if either aluminum hydroxide or hydrated aluminum oxide is used, a bonding composition having a latex to hydrate weight ratio within the range 1:2 to 1:4.5 will produce an excellent fire retardant carpet. More preferably, a latex to hydrate weight ratio within the range 1:2 to 1:4 is used.

As to the manner of introducing the aforesaid antimony oxide or zinc borate into the polyester or polyamide fiber, it may be added to the polymer at the time of polymerization, or it may be blended with the polymer pellets. The concentration of the metal compound in the polymer is preferably 0.05 to 15 percent by weight; more preferably 0.1 to 12 percent.

In the following examples, parts and percentages employed are by weight unless otherwise indicated.

EXAMPLE 1

A reactor equipped with a heater and stirrer was charged with a mixture of 1,520 parts of e-caprolactam and 80 parts of aminocaproic acid. The mixture was then flushed with nitrogen and was stirred and heated to 255° C. over a 1 hour period at atmospheric pressure to produce a polymerization reaction. The heating and stirring was continued at atmospheric pressure under a nitrogen sweep for an additional 4 hours in order to complete the polymerization. Nitrogen was then admitted to the reactor and a small pressure was maintained while the polymer was extruded from the reactor in the form of a polymer ribbon. The polymer ribbon was subsequently cooled, pelletized, washed and then dried. The polymer was a white solid having a relative viscosity of about 50 to 60 as determined at a concentration of 11 grams of polymer in 100 ml. of 90 percent formic acid at 25° C. (ASTM D-789-62T).

The polymer pellets were blended with about 2.4 percent of finely divided antimony oxide ($Sb_2O_3$) in a conventional blender and melt extruded under pressure of 1,5000 psig to a 70-orifice spinnerette to produce a fiber having about 3,600 denier. The fiber was collected, drawn at about 3.2 times the extruded length, and textured with a steam jet to produce yarn suitable for use in carpet. This yarn will hereinafter be called Yarn A. A control yarn containing no antimony oxide was prepared in the same manner as described above. This yarn will hereinafter be called Yarn B.

The yarns were then two-plied by twisting two ends together with a 1.5 S twist. The yarns were tufted into a level lop 20 oz./yd.$^2$ carpet at about 8.0 stitch rate. A relatively pliable nonwoven polypropylene fabric was used as the primary backing. Tufting was carried out on a conventional tufting machine operated to give a pile having a height of 5/32 to 7/32 inch.

About 8 parts of a 50 percent emulsion of a 25/75 ethylene-vinyl chloride copolymer latex was mixed with 8 parts of hydrated aluminum oxide to form a binding composition. On a dry basis, the latex-hydrate weight ratio of the binding composition was 1:2. The mixture was then applied onto the fabric described in the preceding paragraph by conventional means at the rate of 32 oz./yd.$^2$ of carpet on a dry basis. With the dilution described, the penetration of the mixture past the backing and into the tufts of the fabric was less than 1/16 inch so that the aesthetic properties of the pile carpet was not impaired. The carpeting was backed with a secondary jute backing and then passed through an oven at about 125° C. to cure the latex on the carpet. The following table compares the carpets made from Yarn A and Yarn B with respect to the distance burned and the critical energy necessary to propagate the flame as measured by the above-described Critical Radiant Flux Test.

| Carpet System | Distance Burned (cm.) | Critical Energy, Watts/cm.$^2$ |
|---|---|---|
| Made with Yarn A | 43 | 0.455 |
| Made with Yarn B | 62 | 0.235 |

Clearly, the carpet made with Yarn A was significantly more flame-retardant than the carpet made with Yarn B.

EXAMPLE 2

Control carpets were also prepared from Yarn A and Yarn B in accordance with Example 1 except that a conventional styrene-butadiene rubber (SBR) latex was used instead of ethylene-vinyl chloride copolymer (EVC) latex of the present invention. The following table compares the resulting carpets with the carpets made in Example 1, using the above-described Critical Radiant Flux Test. In these tests, the standard deviation ($\sigma$) of the distance burned was about 1.7 cm. so that a difference of 5 cm. is highly significant.

| Carpet System | | Distance Burned (cm.) | Critical Energy, Watts/cm.$^2$ |
|---|---|---|---|
| Fiber | Latex | | |
| Yarn B | SBR | Greater than 91 | Less than 0.130 |
| Yarn A | SBR | 57 | 0.273 |
| Yarn B | EVC | 62 | 0.235 |
| Yarn A | EVC | 43 | 0.455 |

These data show that for optimum flame retardancy, it is critical to use both Yarn A (containing antimony oxide) and the ethylene-vinyl chloride copolymer latex in accordance with the present invention.

In additional comparative tests, it was shown that the use of aluminum hydroxide or hydrated aluminum oxide is also a critical element of the present invention. For example, a conventional carpet containing calcium carbonate as filler instead of hydrated aluminum oxide was completely burned in the above-described Critical Radiant Flux Test.

EXAMPLE 3

A flame-retardant carpet was prepared by the procedure of Example 1 except that the latex used was a vinyl chloride-vinylidene chloride copolymer latex sold by B. F. Goodrich Chemical Company under the trademark GEON 652, and the polymer pellets were blended with about 0.9 percent of the antimony oxide ($Sb_2O_3$). The resulting carpet was tested in accordance with the above-described Critical Radiant Flux Test with the following results:

| Distance Burned (cm.) | Critical Energy, Watts/cm.$^2$ |
|---|---|
| 34 | 0.614 |

These results show that the flame-retardancy of the carpet was significantly better than that of the carpet of Example 1.

EXAMPLE 4

A flame-retardant carpet was prepared by the procedure of Example 3 except that instead of blending antimony oxide with the dried polymer, antimony oxide was added to the polymer pellets during the drying operation, i.e., while being dried, the polymer pellets were tumbled with an emulsion of antimony oxide ($Sb_2O_5$) in amount sufficient to provide 0.5 percent antimony oxide based on the dry weight of the polymer. The resulting carpet was tested in accordance with the above-described Critical Radiant Flux Test with the following results:

| Distance Burned (cm.) | Critical Energy, Watts/cm.$^2$ |
|---|---|
| 40 | 0.500 |

These results show that the flame-retardancy of the carpet compared favorably with that of carpet of Example 1.

EXAMPLE 5

A flame-retardant carpet was prepared by the procedure of Example 4 except that instead of using the vinyl chloride-vinylidene chloride copolymer latex of Example 3, a vinylidene chloride polymer latex was used. A suitable latex is available from Dow Chemical Company as DOW Experimental Latex XD-8600.03. The resulting carpet was tested in accordance with the above-described Critical Radiant Flux Test with the following results:

| Distance Burned (cm.) | Critical Energy, Watts/cm.$^2$ |
|---|---|
| 44 | 0.440 |

These results show that the flame-retardancy of the carpet was not significantly different from that of the carpet of Example 1.

EXAMPLE 6

A flame-retardant carpet was prepared by the procedure of Example 4 except that instead of using the vinyl chloride-vinylidene chloride copolymer latex of Example 3, a vinyl chloride copolymer latex sold by B. F. Goodrich Chemical Company under the trademark GEON 351 was used. The resulting carpet was tested in accordance with the above-described Critical Radiant Flux Test with the following results:

| Distance Burned (cm.) | Critical Energy, Watts/cm.$^2$ |
|---|---|
| 35.5 | 0.586 |

These results shown that the flame-retardancy of the carpet was significantly improved over that of the carpet of Example 1.

EXAMPLE 7

A flame-retardant carpet was prepared by the procedure of Example 1 except that instead of blending the polymer pellets with antimony oxide, the pellets were blended with about 2 percent of finely divided zinc borate hydrate ($2\ ZnO.3\ B_2O_3.3.5\ H_2O$). The resulting carpet was tested in accordance with the above-described Critical Radiant Flux Test with the following results:

| Distance Burned (cm.) | Critical Energy, Watts/cm.$^2$ |
|---|---|
| 39 | 0.519 |

These results show that the flame-retardancy of the carpet was significantly better than that of the carpet of Example 1. Similar improved results were obtained when zinc borate was used and the ethylene-vinyl chloride copolymer latex of Example 1 was replaced with a vinyl chloride-vinylidene chloride copolymer latex sold by B. F. Goodrich Chemical Company under the trademark GEON 652, or a vinyl chloride copolymer latex sold under the trademark GEON 351.

EXAMPLE 8

A flame-retardant carpet was prepared by the procedure of Example 7 except that the latex used was a phosphate-ester-plasticized vinyl chloride latex sold by B. F. Goodrich Chemical Company under the trademark GEON 577. The resulting carpet was tested in accordance with the above-described Critical Radiant Flux Test with the following results:

| Distance Burned (cm.) | Critical Energy, Watts/cm.$^2$ |
|---|---|
| 59 | 0.257 |

These relatively poor results were very surprising in view of the excellent results obtained in Example 7. Apparently, it is not desirable to use a phosphate-ester-plasticized vinyl chloride latex in the process of the present invention. This is particularly pertinent in view of U.S. Pat. No. 3,719,547 to Martin et al. on Flame Retardant Pile Fabric.

We claim:

1. A flame-retardant pile carpet having a relatively pliable primary backing and a tufted surface, said surface being comprised of fibers selected from the group consisting of polyester and polyamide fibers having incorporated therein from 0.05 to 15 percent by weight of a metal compound selected from the group consisting of antimony oxide and zinc borate, said fibers being bonded to said backing with a bonding substance comprising a latex material selected from the group consisting of vinyl chloride and vinylidene chloride polymers and copolymers, and a hydrate material selected from the group consisting of aluminum hydroxide and hydrated aluminum oxide, the ratio by weight of said latex material to said hydrate material being within the range 1:2 to 1:4.5.

2. The carpet of claim 1 wherein the fibers are polyamide fibers.

3. The carpet of claim 1 wherein the fibers are polyester fibers.

4. The carpet of claim 1 wherein 0.1 to 12 percent by weight of the metal compound is incorporated in the fiber.

5. The carpet of claim 1 wherein the metal compound is antimony oxide.

6. The carpet of claim 1 wherein the metal compound is zinc borate.

7. The carpet of claim 1 wherein the hydrate material is aluminum hydroxide.

8. The carpet of claim 1 wherein the hydrate material is hydrated aluminum oxide.

9. The carpet of claim 1 wherein the latex material is a vinyl chloride copolymer.

10. The carpet of claim 1 wherein the latex material is a vinylidene chloride copolymer.

11. The carpet of claim 1 wherein the latex material is a vinylidene chloride polymer.

12. The carpet of claim 1 wherein the latex material is an ethylene-vinyl chloride copolymer.

13. The carpet of claim 1 wherein the latex material is a vinyl chloride-vinylidene chloride copolymer.

14. In a process for producing a pile carpet having a relatively pliable primary backing through which polyamide or polyester fibers are tufted, the improvement which comprises incorporating in said fibers from 0.05 to 15 percent by weight of a compound selected from the group consisting of antimony oxide and zinc borate, and bonding said fibers to said backing with a bonding substance comprising a latex material selected from the group consisting of vinyl chloride and vinylidene chloride polymers and copolymers, and a hydrate material selected from the group consisting of aluminum hydroxide and hydrated aluminum oxide, the ratio by weight of said latex material to said hydrate material being within the range 1:2 to 1:4.5, whereby the carpet has improved flame-retardancy.

* * * * *